US006126044A

United States Patent [19]

Smith

[11] Patent Number: 6,126,044

[45] Date of Patent: Oct. 3, 2000

[54] LOCKABLE SPRAY SYSTEM ACTUATOR

[75] Inventor: Jeremy P. Smith, Loudon, N.H.

[73] Assignee: Summit Packaging Systems, Inc., Manchester, N.H.

[21] Appl. No.: 09/309,450

[22] Filed: May 11, 1999

[51] Int. Cl.[7] ..... B65D 83/00

[52] U.S. Cl. ..... 222/402.14; 222/153.12; 222/182; 222/1

[58] Field of Search ..... 222/402.13, 402.14, 222/153.11, 153.12, 182, 1

[56] References Cited

U.S. PATENT DOCUMENTS

| | | | |
|---|---|---|---|
| 3,137,414 | 6/1964 | Steinkamp | 222/402.14 |
| 3,765,573 | 10/1973 | Landsman | 222/402.14 |
| 4,186,853 | 2/1980 | White | 222/182 |
| 4,506,808 | 3/1985 | Goncalves | 222/182 |
| 4,941,600 | 7/1990 | Berriochoa et al. | 222/402.13 |

*Primary Examiner*—Kevin Shaver
*Assistant Examiner*—Thach Bui
*Attorney, Agent, or Firm*—David and Bujold

[57] ABSTRACT

A lockable actuator assembly comprising a base assembly defining an axial through bore. An actuator is accommodated within the through bore and is pivotably supported by the base assembly in a cantilevered fashion. The actuator has an inlet communicating with a discharged outlet via a central bore and a radial bore. A base portion of the base assembly has a plurality of ribs to facilitate engagement with an exterior surface of a mounting cap. An opposed top portion of the base assembly has a plurality of outwardly facing protrusions which facilitate engagement with an annular elongate member, rib or recess of an over cap to rotatably secure the over cap to the base assembly. The over cap is provided with a cutout to facilitate rotation of the over cap relative to the base assembly. The over cap is also provided with a cam member which is located to engage with a cam surface, provided on the actuator once the over cap is sufficiently rotated relative to the base assembly, to facilitate biasing of the actuator in a dispensing position and provide continuous dispensing of the product contents of the container to which the actuator assembly is affixed. When the over cap is rotated back to its initial inactive position, the actuator and stem are allowed to return back to their initial inactive positions.

20 Claims, 4 Drawing Sheets

LOCKABLE SPRAY SYSTEM ACTUATOR

FIELD OF THE INVENTION

This invention relates to a combined actuator/over cap assembly for an aerosol product which can be locked, in a dispensing position, to facilitate continuous dispensing of the product contents of an aerosol container when actuated by an operator via rotation of the over cap from an inactive position to an active position.

BACKGROUND OF THE INVENTION

There are a variety of prior art dispensing system which are currently available in the marketplace. Many of these systems are designed for intermittent discharge of product contents and are suitable for such applications. However, there are some applications where a continuous dispensing of the entire product contents, or a substantial portion of the product contents, of an aerosol or other pressurized container is desired by an operator. When continuous dispensing of the entire product contents is desired, it is tedious and cumbersome for the operator to depress continuously the actuator of the aerosol container to facilitate dispensing of the desired quantity of the product contents.

This shortcoming is especially true when an individual is, for example, inflating a tire via a currently available tire inflation aerosol container. Typically, the tire inflation procedure takes several seconds or even a few minutes to completely inflate a tire with one of the currently available tire inflation aerosol products. Moreover, when changing a tire, the person inflating the tire is many times distracted by on-coming traffic thereby rendering it more difficult for the operator to concentrate on depressing the actuator and properly inflating the tire. The tire inflation procedure may be compounded further if an elderly, a handicapped or some other impaired individual is operating the container to inflate the tire. In addition, the known lockable prior art dispensing systems are not recloseable once the dispensing of the pressurized product contents has commenced.

SUMMARY OF THE INVENTION

Wherefore, it is an object of the present invention to overcome the aforementioned problems and drawbacks associated with the dispensing systems currently known in the prior art.

Another object of the invention is to provide an actuator assembly which can be locked in a continuous dispensing position to facilitate dispensing of the entire contents of the aerosol container, or a substantial portion thereof, without an operator having to continuously maintain the actuator in a depressed condition by manual depression of the same.

A further object of the present invention is to allow a continuous dispensing of an aerosol container to be interrupted, as desired, by rotation of the over cap, in a convenient and simple manner, which shuts off the flow of the aerosol contents through the valve coupled to the actuator.

Still another object of the invention is to provide an actuator dispensing assembly which is relatively inexpensive to manufacture, is lightweight and durable, and can be readily mass produced.

Yet another object of the invention is to provide an actuator dispensing assembly which can be opened and closed numerous times as desired by an operator.

The present invention relates to a lockable actuator assembly comprising: a base assembly defining a longitudinal axis and having a through bore extending axially therethrough, said base assembly having a base portion for engagement with a mounting cup of a pressurized container to secure the lockable actuator assembly thereto; an actuator being accommodated within said through bore, said actuator having an inlet communicating with a discharged outlet for conveying product to be dispensed by said actuator assembly, and said actuator having a camming surface; and an over cap being rotatably secured to an opposed top portion of said base assembly, said over cap having a mating cam member located to engage with said cam surface of said actuator, and said cam member, when in a first inactive position, insufficiently actuating said actuator and said cam member, when in a second active position, engaging said cam surface and actuating said actuator to facilitate dispensing of the product to be dispensed through said inlet and out said discharge outlet of said actuator assembly.

The present invention also relates to a pressurized container in combination with a lockable actuator assembly, said pressurized container being a closed container which is sealed by a mounting cup accommodating a normally closed valve therein, said normally closed valve being at least partially accommodated with an interior space of said pressurized container and having a valve stem extending through a central aperture being provided in said mounting cup, and said valve being biased into a normally closed position; and said lockable actuator comprising: a base assembly defining longitudinal axis and having a through bore extending axially therethrough, said base assembly having a base portion engaging with said mounting cup of said pressurized container to secure the lockable actuator assembly thereto; an actuator being accommodated within said through bore, said actuator having an inlet communicating with a discharged outlet for conveying product to be dispensed by said actuator assembly, said inlet communicating with said valve stem, and said actuator having a camming surface; and an over cap being rotatably secured to an opposed top portion of said base assembly, said over cap having a cam member located to engage with said cam surface of said actuator, and said cam member, when in a first inactive position, insufficiently actuating said actuator and, said cam member, when in a second active position, engaging said cam surface and sufficiently actuating said actuator to dispense the product to be dispensed from said pressurized container through said inlet and out said discharge outlet of said actuator assembly.

BRIEF DESCRIPTION OF THE DRAWINGS

The invention will now be described, by way of example, with reference to the accompanying drawings in which.

DESCRIPTION OF THE PREFERRED EMBODIMENTS

Figure 1:
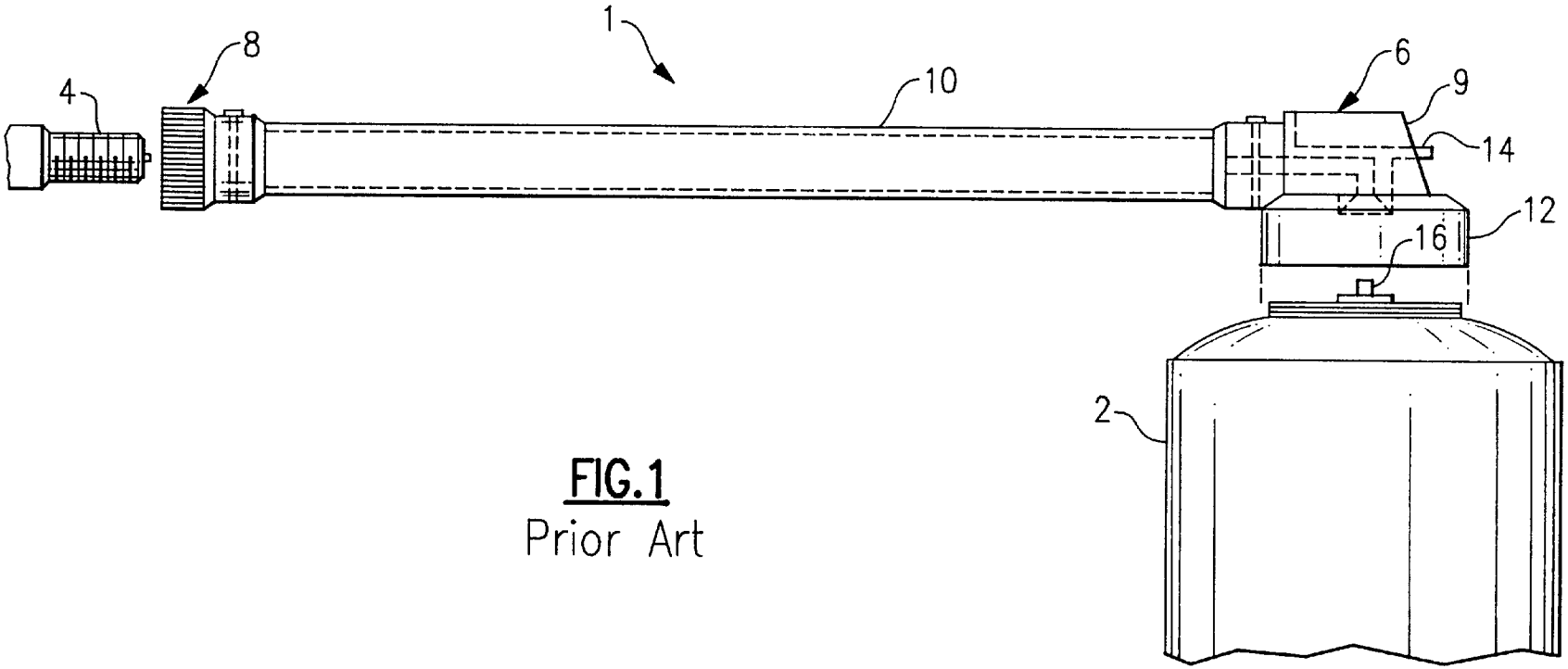
FIG.1 Prior Art
FIG. 1 is a diagrammatic front elevational view of a prior art tire inflation hose assembly for facilitating inflation of a deflated tire.

Turning now to FIG. 1, a brief description concerning one prior art arranmgement for the dispensing actuator assembly, will now be provided. According to this arrangement, a tire inflation hose assembly 1, for connecting a container 2 of a pressurized tire inflation material to a conventional tire stem 4, is illustrated. The hose assembly 1 includes a releasable valve assembly 6, adapted to be coupled to a stem 16 extending from a top surface of the container 2, for controlling the release of the pressurized inflation material. The release valve assembly 6 is coupled to one end of a flexible hollow tube 10, by an internal conduit, while the opposite end of the flexible tube 10 supports a conventional nozzle 8 for coupling the tire inflation hose assembly 1 to the tire valve stem 4. The flexible tube 10 transports the released pressurized inflation material from the release valve assembly 6 to the nozzle 8 from where it is finally discharged into the tire, via the valve stem 4.

The release valve assembly 6 includes a body, generally designated as 9, having an attachment mechanism, such as a housing 12, which can be removably secured to the top surface of the container 2 in a friction fit or some other conventional and well known manner. When a downward force is applied to a pressurized container valve, such as via a lever 14, the stem 16 of the container 2 is forced downward to release the pressurized inflation material from the interior of the container 2. The released pressurized inflation material travels from the interior of the container to the release valve assembly 6 and into and through the hollow flexible tube 10. The pressurized inflation material is ultimately conveyed to the opposite end of the flexible tube 10 and discharged by the nozzle 8 and the valve 4 into an interior space of the tire or any other product or item to be inflated, sprayed, etc.

Turning now to FIGS. 2–8, a detailed description concerning the improved continuous dispensing actuator assembly 20, according to the present invention, will now be described. For the sake of simplicity, the actuator assembly 20 will first be described, with reference to FIGS. 2–4, with the over cap 22 removed therefrom. Once a detailed description of the actuator base 24 is provided, then a detailed description of the over cap 22, and its interaction with the actuator base 24, will be provided.

Figure 2:
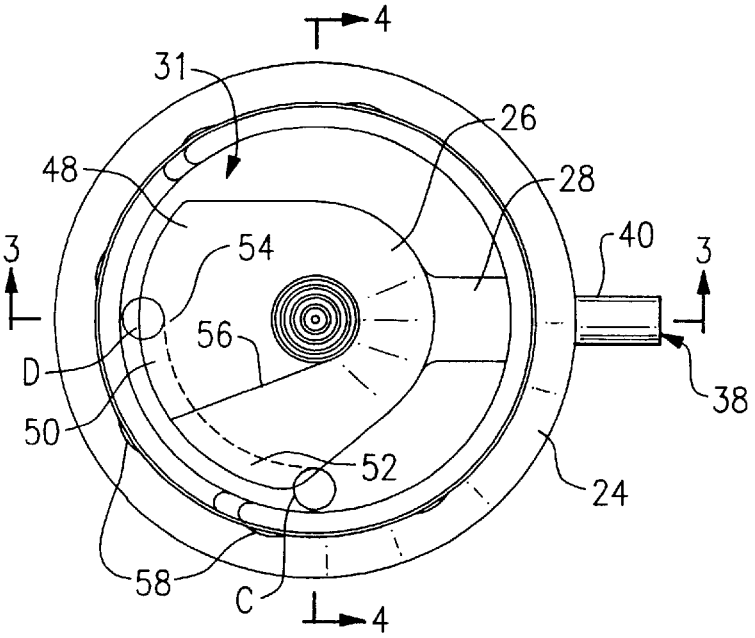
FIG. 2 is a diagrammatic top plan view, with the over cap removed from the base assembly for reasons of clarity, of the improved continuous dispensing actuator assembly according to the present invention.
Figure 3:
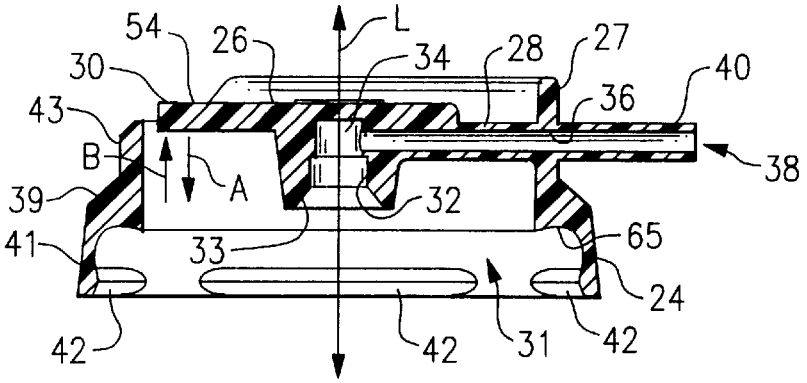
FIG. 3 is a diagrammatic cross sectional view of the actuator, along section line 3—3 of FIG. 2.
Figure 4:
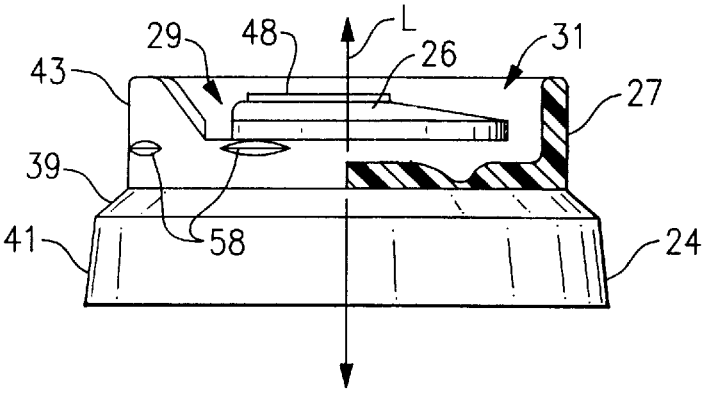
FIG. 4 is a diagrammatic rear elevational view of the actuator of FIG. 2, shown partly is cross section along section line 4—4 of FIG. 2.

With reference to FIGS. 2–4, the actuator base 24 is a generally cylindrically shaped member defining a longitudinal axis L of the actuator assembly 20. The actuator base 24 supports an actuator 26 for facilitating dispensing of the pressurized contents of the container when the actuator 26 is sufficiently depressed, as will be discussed below in further detail. The actuator 26 is pivotably connected to a side wall 27 of the actuator base 24 in a cantilevered fashion, via an arm 28, to facilitate down and up movement of the free end 30 of the actuator 26, relative the actuator base 24 (i.e. in the direction of arrows A and B of FIG. 3), from an inactive position (FIG. 7) to an inactive position (FIG. 8) and vice versa, and a further detailed description concerning the same will follow. If desired, an assembly cutout 29 is provided in a portion of the side wall 27, i.e. a removed section of the side wall, adjacent a free end 30 of the actuator 26. The assembly cutout 29 allows a finger of an operator to manually depress the actuator 26 in the event that the over cap 22 is removed for some reason.

The actuator base 24 has a through bore 31 which extends therethrough along the longitudinal axis L of the actuator assembly 20. The through bore 31 accommodates the actuator 26 and facilitates the down and up pivoting movement of the free end of the actuator 26, relative to the actuator base 24, in a substantially unrestricted manner.

A bottom downwardly facing surface of the actuator 26 is provided with a centrally located inlet 32 which communicates with a central bore 34 which is concentric with the longitudinal axis L of the actuator assembly 20. The inlet 32 is provided with an annular chamfered or beveled surface 33 which facilitates engagement of the inlet 32 and a stem 78 of an aerosol container (see FIGS. 7 and 8). As such coupling feature is conventional and well known in the art, a detailed description concerning the same is not provided.

A radial bore 36 interconnects a remote end of the central bore 34 with a discharge outlet 38 to facilitate dispensing of the product contents through the actuator 26. It is to be appreciated that a portion of the radial bore 36 extends through the arm 28 and the orientation of the radial bore 36 will be altered slightly during depression of the free end 30 of the actuator 26.

As can be seen in FIG. 2, the discharge outlet 38 is formed in a remote end face of a nozzle 40. The nozzle 40 is generally a cylindrically shaped member and such configuration facilitates ease of coupling the nozzle 40 with a hollow flexible tube or some other coupling member to connect the continuous dispensing actuation assembly 20 with a desired component, member, assembly, product, item, etc., to be pressurized. As such coupling of the nozzle 40 to another component, member, assembly, product, item, etc., is conventional and well known in the art, a detailed description concerning the same is not provided.

As can be seen in FIGS. 3 and 4, the exterior surface of the actuator base 24 has an inward step 39 which is located between the larger diameter base portion 41 of the actuator base 24 and the slightly smaller diameter over cap top end portion 43. An inwardly facing surface of the base portion 41 is provided with a plurality of inwardly facing gripping members such as elongate ribs 42, spaced from one another, which facilitate engagement of the base portion 41 of the through bore 31 and an exterior surface of a mounting cup 44 of a pressurized container 46 (see FIGS. 7 and 8). Afurther detailed description concerning the purpose of such engagement will be provided below.

As can be seen in FIG. 2, the actuator 26 is provided with a top surface 48 which fills a substantial portion or area of the through bore 31. The outer perimeter of the top surface 48 is provided with an inclined ram or cam surface 50, as can be seen in FIG. 4. That is, the edge portion of the top surface 48, located adjacent the cylindrical inwardly facing side wall 27 of the base assembly 24 defining the through bore 31, has a slight taper. In particular, the cross sectional thickness of the actuator 26 has a relatively flat and thin area 52 which gradually tapers to a relatively flat and thick area 54. If desired, there can be a relatively quick transition 56 between the two relatively flat areas 52, 54, for example. The degree of taper between the two relatively flat areas 52, 54 will dictate the amount of resistance an operator experiences in rotating the over cap 22 relative to the base assembly 24 to sufficiently depress the actuator 26. It is to be appreciated that various other camming arrangements can be utilized to facilitate sufficient depression of the actuator 26 in accordance with the teaching of the present invention.

As can be seen in FIG. 4, the exterior surface of the base assembly 24 is provided with a plurality of short spaced apart outwardly facing annular nubs or protrusions 58. These nubs or protrusions 58 are positioned for engagement with an annular member, rib or recess 64 of the over cap 22 to secure the over cap 22 to the base assembly 24, and a further detailed description concerning the purposed of the same will be provided.

Figure 5:
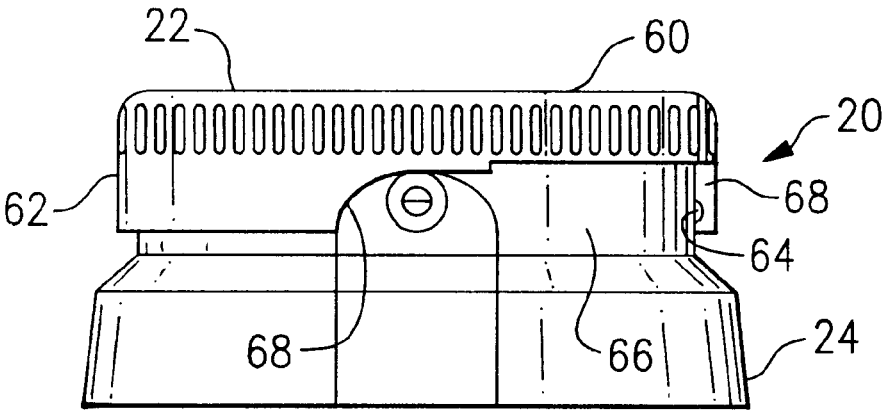
FIG. 5 is a diagrammatic front elevational view of the improved continuous dispensing actuator assembly, according to the present invention, with the over cap shown attached to the base assembly.
Figure 6:
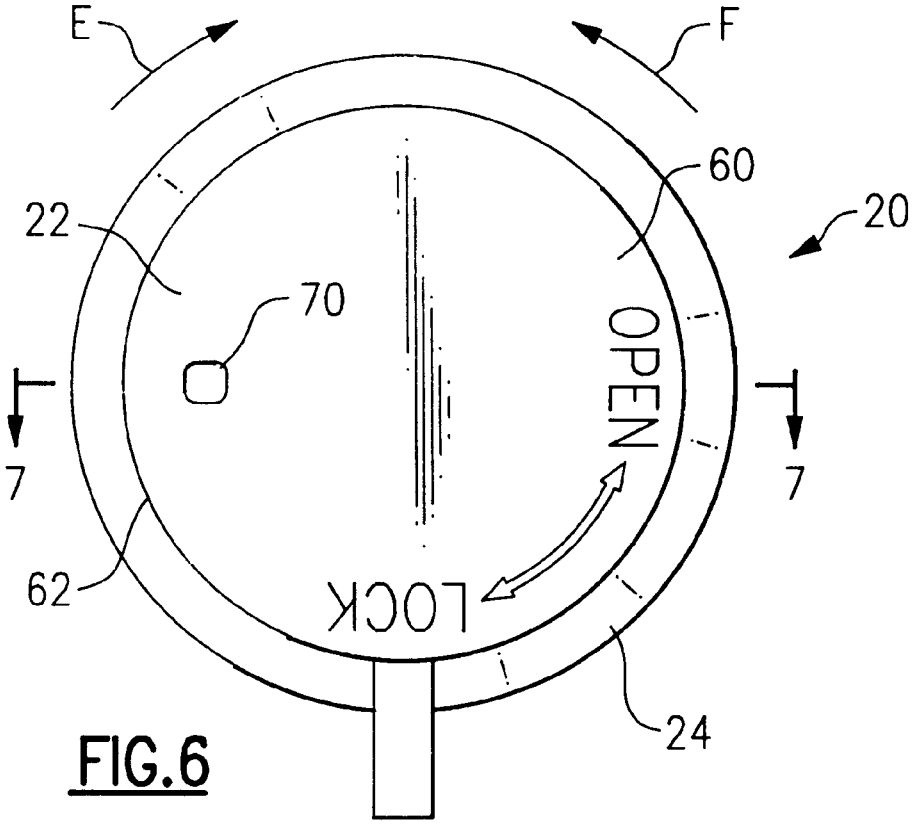
FIG. 6 is a diagrammatic top plan view of the improved continuous dispensing actuator assembly of FIG. 5.

With reference to FIGS. 5 and 6, a detailed description concerning the over cap 22, according to the present invention, will now be provided. As can be seen in these Figures, the over cap 22 is a shallow hollow member which is sized to fit over and closely accommodate the top portion 43 of the base assembly 24. The over cap 22 has a top wall 60 and an annular side wall 62. The inwardly facing surface of the annular side wall 62 is provided with the annular elongate member, rib or recess 64 which is located to mate with the plurality of nubs or protrusions 58, provided on the exterior surface of the base assembly 24, to facilitate a retaining engagement between the over cap 22 and the base assembly 24. A cutout 66 is provided in a portion of the side wall 62, i.e. a removed section of the side wall, to allow the over cap 22 to be secured to the base assembly 24 without interference from the nozzle 40. The cutout 66 also facilitate limited rotation of the over cap 22 relative to the base assembly 24. The cutout 66 generally extends over a perimeter arc length of about 90° or so as to allow the over cap 22 to rotate 90° relative to the base assembly 24. The cutout 66 has two opposed end surfaces 68 which function as stops and abut against a portion of the nozzle to prevent excess rotation of the over cap 22 relative to the base assembly 24.

An inwardly downwardly facing surface of the base wall 62 is provided with a cam protrusion or member 70 which is located to engage with the cam surface 50 of the actuator 26. When the over cap 22 is in the position shown in FIG. 5, the cam member 70 is located in the position C relative to the actuator 26, as can be seen in dashed lines in FIG. 2. When the cam member 70 and the cam surface 50 are in this orientation, the actuator 26 is in its normal unbiased position, spaced a sufficient distance away from the stem 78 of the aerosol container 46, so that the product contents are not dispensed from the aerosol container 46. When the over cap 22 is rotated 90° from the position shown in FIG. 5 (i.e. rotated in the direction of arrow E shown in FIG. 6), to the active position shown in FIG. 8, e.g. to D position shown in dashed lines in FIG. 2, the cam member 70 rides along the cam surface 50 of the actuator 26 and sufficiently depresses the actuator 26 in a downward direction (in the direction of arrow A). This motion, in turn, depresses the stem 78 and opens the valve to facilitate dispensing of the product contents up through valve stem 78 into the inlet 32 and through the central bore 34, the radial bore 36 and out through the discharge outlet 38 of the actuator assembly 20.

Due to the locking engagement between the nubs or protrusions 58, provided on the exterior surface of the base assembly 24, and the annular elongate rib or recess 64, provided on the inwardly facing surface of the over cap 22, the cam member 70 provides a continuous camming action of the top surface of the actuator 26 to maintain the actuator 26 in a fully depressed position and facilitates continuous dispensing of the product contents from the pressurized container 46. When the operator desires to interrupt the continuous flow or dispensing of the product contents from the pressurized container 46, the operator merely rotates the over cap 22, relative to the base assembly 24, in the opposite direction (i.e. in the direction of arrow F shown in FIG. 6) back to the over cap position as seen in FIG. 5. Such rotation of the over cap 22 causes the cam member 70 to ride along the cam surface 50 and thus move from position D to position C, shown in FIG. 2, thereby allowing the actuator 26 to pivot upward, relative to the base assembly 24, in the direction of arrow B to its normal inactive position. The complete disengagement of the cam member 70 from the cam surface 50, or at least a sufficient relief of the camming pressure provided between those two components, allows the valve assembly to return back to its normal spring bias closed position and thus interrupt the flow of product contents to the actuator assembly 20.

Figure 7:
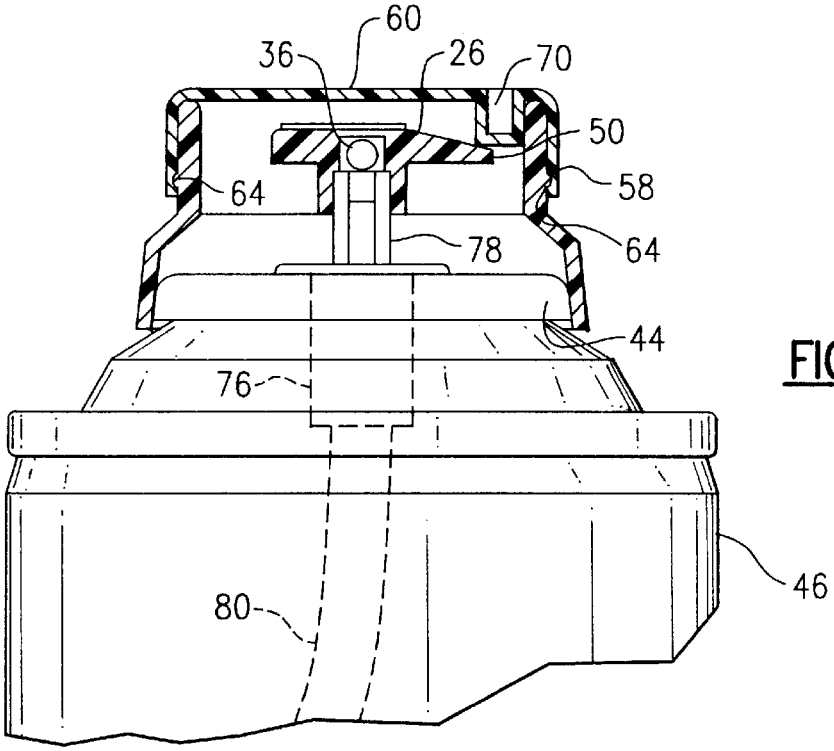
FIG. 7 is a diagrammatic partial cross-sectional view, along section line 7—7 of FIG. 6, showing the inactive position of the improved continuous dispensing actuator assembly according to the present invention.
Figure 8:
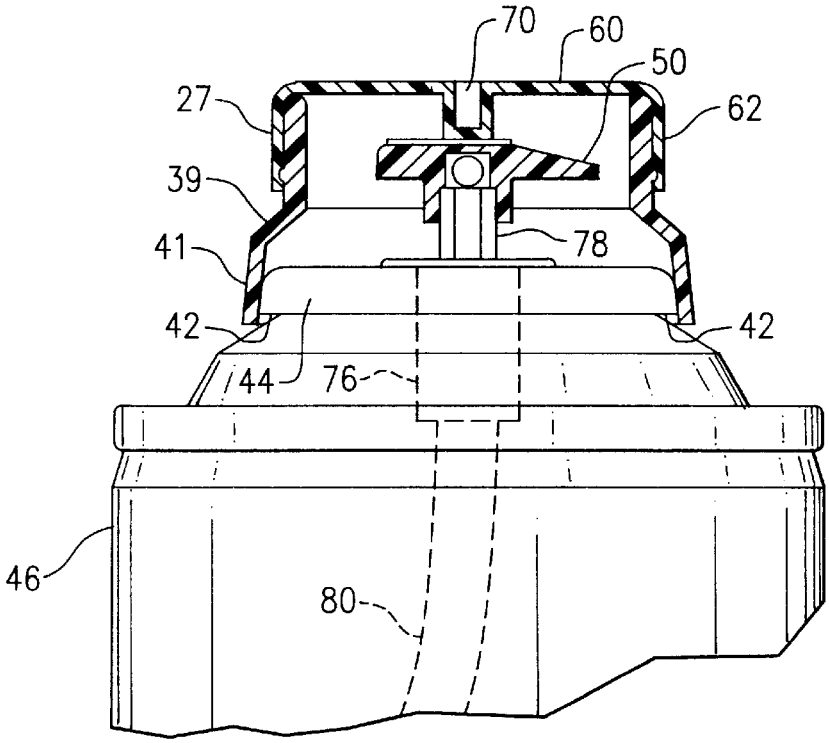
FIG. 8 is a diagrammatic cross-sectional view, similar to the view of FIG. 7, showing the active continuous dispensing position of the improved continuous dispensing actuator assembly according to the present invention.

With reference to FIGS. 7 and 8, the interaction between the dispensing actuator assembly 20, according to the present invention, with a conventional aerosol container 46 will now be provided. As can be seen in those Figures, the aerosol container generally comprises a closed aerosol container 46 which provided with a mounting cup 44 for sealing a top portion of the aerosol container 46. The mounting cup 44 supports a valve assembly 76 (not shown in detail) within the central portion of the mounting cup 44 and a valve stem 78 extends from the valve assembly 76 through a central aperture provided in the mounting cup 44. If desired, an internal dip tube 80 may couple an inlet of the valve assembly 76 with a base of the aerosol container 46 to facilitate dispensing liquid and/or solid contents from the aerosol container 46. As such teaching in conventional and well known in the art, a further detailed description concerning the same will not be provided.

When attachment of the dispensing actuator assembly 20 to the aerosol container 46 is desired, the through bore 31 of the actuator assembly 24 is aligned with the mounting cup 44 and the mounting cup 44 is received within the through bore 31 so that the inwardly facing ribs 42 of the base assembly 24 engage with a lower edge of the mounting cup 44 to securely retain the dispensing actuator assembly 20 in a proper position on the aerosol container 46. The base assembly 24 is provided with a shoulder 65 to prevent over insertion of the mounting cup 44 within the through bore 31 (see FIG. 3). Once the base assembly 24 is so engaged with the mounting cup 44, the actuator assembly 20 is substantially permanently retained on the aerosol container 46 and the stem 78 is received within the inlet 31 of the actuator 26. When dispensing of the product contents is desired, an operator merely rotates the over cap 22 a desired angle, i.e. an angle of at least about 10°, more preferably an angle of at least about 45°, and most preferably an angle of about 90°, relative to the base assembly 24 (i.e. in the direction of arrow E in FIG. 6) to allow the cam member 70 to ride along the cam surface 50 of the actuator 26 and bias the actuator 26 in the direction of arrow A and thereby sufficiently depress the valve stem 78 to commence the flow of the product contents through the actuator 26. If the operator desires to interrupt the flow of the product contents, the over cap 22 is merely rotated a desired angle, e.g. 90°, in the opposite direction (i.e. in the direction of arrow F in FIG. 6) to allow the cam member 70 to again ride along the cam surface 50, and allow the cantilevered actuator 26 to pivot back to its initial unbiased position (to return back to position C from position D shown in FIG. 2).

It is to be appreciated that while the present invention describes 90° rotation of the over cap 22 relative to the base assembly 24, a lesser or greater amount of rotation can be utilized. The important feature is that there must be sufficient rotation between the two components to allow the camming effect between the cam member and the cam surface to sufficiently depress the actuator. In addition, it is to be appreciated that other camming arrangements, which are conventional and well known in the art, can be utilized in place of the cam member 70 and the cam surface 50 as disclosed herein. In addition, other locking arrangements between the over cap 22 and the base assembly 24 and between the base assembly 24 and the mounting cup 44 can be utilized in place of the specifically disclosed locking arrangements. An important feature, according to the present invention, is that there is sufficient rotation between the over cap 22 and the base assembly 24 to facilitate the desired camming action of the actuator 26 and a secure engagement between the base assembly 24 and the mounting cup 44.

Since certain changes may be made in the above described improved continuous dispensing actuator assembly, without departing from the spirit and scope of the invention herein involved, it is intended that all of the subject matter of the above description or shown in the accompanying drawings shall be interpreted merely as examples illustrating the inventive concept herein and shall not be construed as limiting the invention.

Wherefore, I claim:

1. A lockable actuator assembly comprising:

a base assembly defining a longitudinal axis and having a through bore extending axially therethrough, said base assembly having a base portion for engagement with a mounting cup of a pressurized container to secure the lockable actuator assembly thereto;

an actuator being accommodated within said through bore, said actuator having an inlet communicating with a discharged outlet for conveying product to be dispensed by said actuator assembly, and said actuator having a camming surface; and an over cap being rotatably secured to an opposed top portion of said base assembly, said over cap having a mating cam member located to engage with said cam surface of said actuator, and said cam member, when in a first inactive position, insufficiently actuating said actuator and said cam member, when in a second active position, engaging said cam surface and actuating said actuator to facilitate dispensing of the product to be dispensed through said inlet and out said discharge outlet of said actuator assembly.

2. The lockable actuator assembly according to claim 1, wherein said over cap comprises a top wall and an annular side wall, and said annular side wall has a cutout formed therein to facilitate limited rotation of said over cap relative to said base assembly.

3. The lockable actuator assembly according to claim 1, wherein said actuator is connected to said actuator base via an arm in a cantilevered fashion to facilitate pivoting movement of a free end of said actuator relative to said base assembly within said through bore.

4. The lockable actuator assembly according to claim 1, wherein said inlet of said actuator communicates with a central bore and a radial bore couples said central bore with said discharge outlet.

5. The lockable actuator assembly according to claim 1, wherein said base portion of said base assembly, which is sized to mate with a mounting cup, is provided with a plurality of retaining ribs which are located to engage with an exterior surface of the mounting cup to secure the base assembly to the mounting cup.

6. The lockable actuator assembly according to claim 1, wherein an exterior outwardly facing surface of said top portion of said base assembly is provided with a plurality of protrusions, and said protrusions are located to engage with an annular elongate member provided on an inwardly facing surface of said over cap to secure said over cap to said base assembly while facilitating rotation of said over cap relative to said base assembly.

7. The lockable actuator assembly according to claim 1, wherein a nozzle extends perpendicular to a longitudinal axis of said base assembly, and said nozzle supports said discharge outlet on a remote end face thereof.

8. The lockable actuator assembly according to claim 2, wherein a pair of opposed end surfaces of said cutout form stops which are engageable with a nozzle, which supports said discharge outlet, to limit rotation of said over cap relative to said base assembly.

9. The lockable actuator assembly according to claim 1, wherein said base portion of said base assembly has a larger diameter than said opposed top portion of said base assembly and a step is provided between said top portion and said base portion.

10. The lockable actuator assembly according to claim 2, wherein said cam member is supported by a top surface of said over cap and said cam member and is located adjacent a side wall of said over cap to engage with the cam surface of said actuator.

11. The lockable actuator assembly according to claim 1, wherein said inlet is surrounded by an annular chamfer to facilitate engagement between said inlet and a stem of a desired pressurized container.

12. A lockable actuator assembly according to claim 1, wherein said cam member of said over cap is located to engage with a perimeter portion of said actuator to generate a sufficient actuation force on said actuator, and said cam surface comprises a top surface of said actuator which is provided with two relatively flat areas and a transition is located between said two relatively flat areas.

13. A pressurized container in combination with a lockable actuator assembly, said pressurized container being a closed container which is sealed by a mounting cup accommodating a normally closed valve therein, said normally closed valve being at least partially accommodated with an interior space of said pressurized container and having a valve stem extending through a central aperture being provided in said mounting cup, and said valve being biased into a normally closed position; and said lockable actuator comprising:

a base assembly defining longitudinal axis and having a through bore extending axially therethrough, said base assembly having a base portion engaging with said mounting cup of said pressurized container to secure the lockable actuator assembly thereto;

an actuator being accommodated within said through bore, said actuator having an inlet communicating with a discharged outlet for conveying product to be dispensed by said actuator assembly, said inlet communicating with said valve stem, and said actuator having a camming surface; and an over cap being rotatably secured to an opposed top portion of said base assembly, said over cap having a cam member located to engage with said cam surface of said actuator, and said cam member, when in a first inactive position, insufficiently actuating said actuator and, said cam member, when in a second active position, engaging said cam surface and sufficiently actuating said actuator to dispense the product to be dispensed from said pressurized container through said inlet and out said discharge outlet of said actuator assembly.

14. The combination according to claim 13, wherein said over cap comprises a top wall and an annular side wall, and said annular side wall has a cutout formed therein to facilitate limited rotation of said over cap relative to said base assembly.

15. The combination according to claim 13, wherein said actuator is connected to said actuator base via an arm in a cantilevered fashion to facilitate pivoting movement of a free end of said actuator relative to said base assembly within said through bore.

16. The combination according to claim 13, wherein said base portion of said base assembly, which is sized to mate with a mounting cup, is provided with a plurality of retaining ribs which are located to engage with an exterior surface of the mounting cup to secure the base assembly to the mounting cup; and an exterior outwardly facing surface of said top portion of said base assembly is provided with a plurality of protrusions, and said protrusions are located to engage with an annular elongate member provided on an inwardly facing surface of said over cap to secure said over cap to said base assembly while facilitating rotation of said over cap relative to said base assembly.

17. The combination according to claim 13, wherein a nozzle extends perpendicular to a longitudinal axis of said base assembly, and said nozzle supports said discharge outlet on a remote end face thereof.

18. The combination according to claim 13, wherein said cam member is supported by a top surface of said over cap and said cam member and is located adjacent a side wall of said over cap to engage with the cam surface of said actuator.

19. The combination according to claim 13, wherein said cam member of said over cap is located to engage with a perimeter portion of said actuator to generate a sufficient actuation force on said actuator, and said cam surface comprises a top surface of said actuator which is provided with two relatively flat areas and a transition is located between said two relatively flat areas.

20. A method of providing a pressurized container with a lockable actuator assembly, the method comprising the steps of:

defining a longitudinal axis with a base assembly and having a through bore extending axially therethrough;

engaging a base portion of said base assembly with a mounting cup of a pressurized container to secure the lockable actuator assembly thereto;

accommodating an actuator within said through bore, said actuator having an inlet communicating with a discharged outlet for conveying product to be dispensed by said actuator assembly, and said actuator having a camming surface;

coupling said inlet with a valve stem of said pressurized container;

rotatably psecuring an over cap to an opposed top portion of said base assembly, said over cap having a mating cam member located to engage with said cam surface of said actuator, and said cam member, when in a first inactive position, insufficiently actuating said actuator and said cam member, when said over cap is rotated to a second active position, said cam member engages said cam surface and actuates said actuator to dispense product through said inlet and out said discharge outlet of said actuator assembly.

* * * * *